US006102798A

United States Patent [19]

Bennett

[11] Patent Number: 6,102,798

[45] Date of Patent: Aug. 15, 2000

[54] SLOT MACHINE GAME-FIND THE PRIZE

[75] Inventor: Nicholas Luke Bennett, Manly Vale, Australia

[73] Assignee: Aristocrat Technologies Australia Pty Ltd., Lane Cove, Australia

[21] Appl. No.: 08/991,899

[22] Filed: Dec. 17, 1997

[30] Foreign Application Priority Data

Dec. 18, 1996 [AU] Australia ..... PO 4295

[51] Int. Cl.[7] ..... A63F 9/22

[52] U.S. Cl. ..... 463/16

[58] Field of Search ..... 463/16–19, 20, 463/12, 13; 273/143 R, 138 A, 434, 856

[56] References Cited

U.S. PATENT DOCUMENTS

| | | | |
|---|---|---|---|
| 4,403,777 | 9/1983 | Del Principe et al. | 273/313 |
| 5,580,053 | 12/1996 | Crouch | 463/20 |
| 6,015,346 | 7/1998 | Bennett | 463/20 |

FOREIGN PATENT DOCUMENTS

| | | | |
|---|---|---|---|
| 2229371 | 9/1990 | United Kingdom | 463/16 |
| 2 233 240 | 3/1991 | United Kingdom | 273/434 |
| 2 233 241 | 9/1991 | United Kingdom | 273/434 |
| 2252705 | 8/1992 | United Kingdom | 463/20 |
| 2271262 | 4/1994 | United Kingdom | 463/20 |

*Primary Examiner*—Jessica J. Harrison
*Assistant Examiner*—Sheila Clayton
*Attorney, Agent, or Firm*—Rosenman & Colin LLP

[57] ABSTRACT

A slot machine is provided in a cabinet 10 including a prize display 12, a coin entry slot 13. a payout tray 14 and internally mounted game control processor circuits. The game display means 11 comprises a video display screen 11 controlled to display a game image divided into a matrix of elements or player selectable zones. The video screen is preferably of the touch sensitive variety, having an array of touch sensitive areas located on its display surface with one such area associated with each matrix element 40-54. The player may select one of the matrix elements (eg. 41) by touching the screen within the area of the respective element to be selected, thereby causing the image in the element to change to reveal whether or not a prize value is associated with that zone.

51 Claims, 8 Drawing Sheets

SLOT MACHINE GAME-FIND THE PRIZE

INTRODUCTION

The present invention relates to gaming machines of the type generally referred to as slot machines, fruit machines or poker machines, and in particular the invention provides a new game played on such a machine.

Players who regularly play gaming machines quickly tire of particular games and therefore it is necessary for manufacturers of these machines to come up with innovative games or game features that add interest to the games provided on such machines in order to keep the players amused and therefore willing to continue playing the game.

DESCRIPTION OF THE PRIOR ART

Gaming or poker machines have been well known in Australia, the state of Nevada, and many other jurisdictions for many years and have more recently gained considerable popularity throughout the world, with quite substantial amounts of money wagered on these machines. There is a growing tendency for State governments to legalise the use of gaming machines by licensing operators, with resulting revenue gains through licence fees and taxation of monies invested. The licensed operation of gaming machines is the subject of State legislation and regulation. This regulation most always dictates a minimum percentage payout for a gaming machine. For example, a minimum of 85% of monies invested must be returned as winnings, and manufacturers of gaming machines therefore must design their machines around these regulatory controls.

With the growth that has occurred in the gaming machine market there is intense competition between manufacturers to supply the various existing and new venues. When selecting a supplier of gaming machines, the operator of a venue will often pay close attention to the popularity of various games with their patrons.

Therefore, gaming machine manufacturers are keen to devise games which are popular with players, as a mechanism for improving sales.

In particular, manufacturers regularly devise new games which have not previously been seen on slot machines in order to stimulate renewal of player interest.

SUMMARY OF THE INVENTION

The present invention provides a slot machine including display means arranged to display a game being played on the machine, game initiating means to initiate a game on the machine and game control means responsive to the initiating means to control the playing of the game, characterised in that:

the display means is arranged to display a game image having a plurality of player selectable zones, the control means including player zone selection means, a prize being randomly associated with at least one of the zones such that if that zone is selected by a player the player will be awarded the associated prize, and the control means being arranged to randomly select zones of the plurality of zones one at a time and to indicate for each selected zone whether that zone has an associated prize, the random selection being continued by the control means until either, the player selects a zone, or all of the zones with associated prizes have been selected by the control means.

In various embodiments of the invention the background image for the game may be a static or dynamic image or an animation or fixed pattern. Alternatively there may be no significant background and each of the zones may be provided with its own graphic design.

In one embodiment, clues are provided to assist the player in determining the probability of a particular zone being the winning zone.

Preferably, the zone selection means includes touch sensors associated with the display means such that touching the display means within the area of one of the player selectable zones causes the respective zone to be selected. Preferably, the display means is a video screen or LCD panel and touch sensors are touch switches associated with zones of the display.

In some embodiments, the game image may display a sportsman playing his sport or a scene covering a hidden target. Examples include a golfer teeing off, a soccer player kicking a ball, in which case a prize will be hidden in a zone where the ball might be expected to be found. Other examples include, a rugby player passing a ball, an angler casting his fly, in which case the probable location of the fly will indicate the prize location or a battleship dropping a depth charge or firing missiles, in which case the probable location of the target will indicate the prize. In each of the examples, the screen image gives a clue to the player as to the zone having a prize associated with it.

In other embodiments, clues may be permanently or temporarily revealed in zones that have been randomly selected by the control means or alternatively clues might be permanently or temporarily displayed in unselected zones.

BRIEF DESCRIPTION OF THE DRAWINGS

Embodiments of the present invention will now be described by way of example with reference to the accompanying drawings in which.

DETAILED DESCRIPTION OF THE PREFERRED EMBODIMENTS

In the following detailed description, the methodology of the embodiments will be described and it is to be understood that it is within the capabilities of the non-inventive worker in the art to introduce the methodology on any standard microprocessor based gaming machine by means of appropriate programming.

Figure 1:
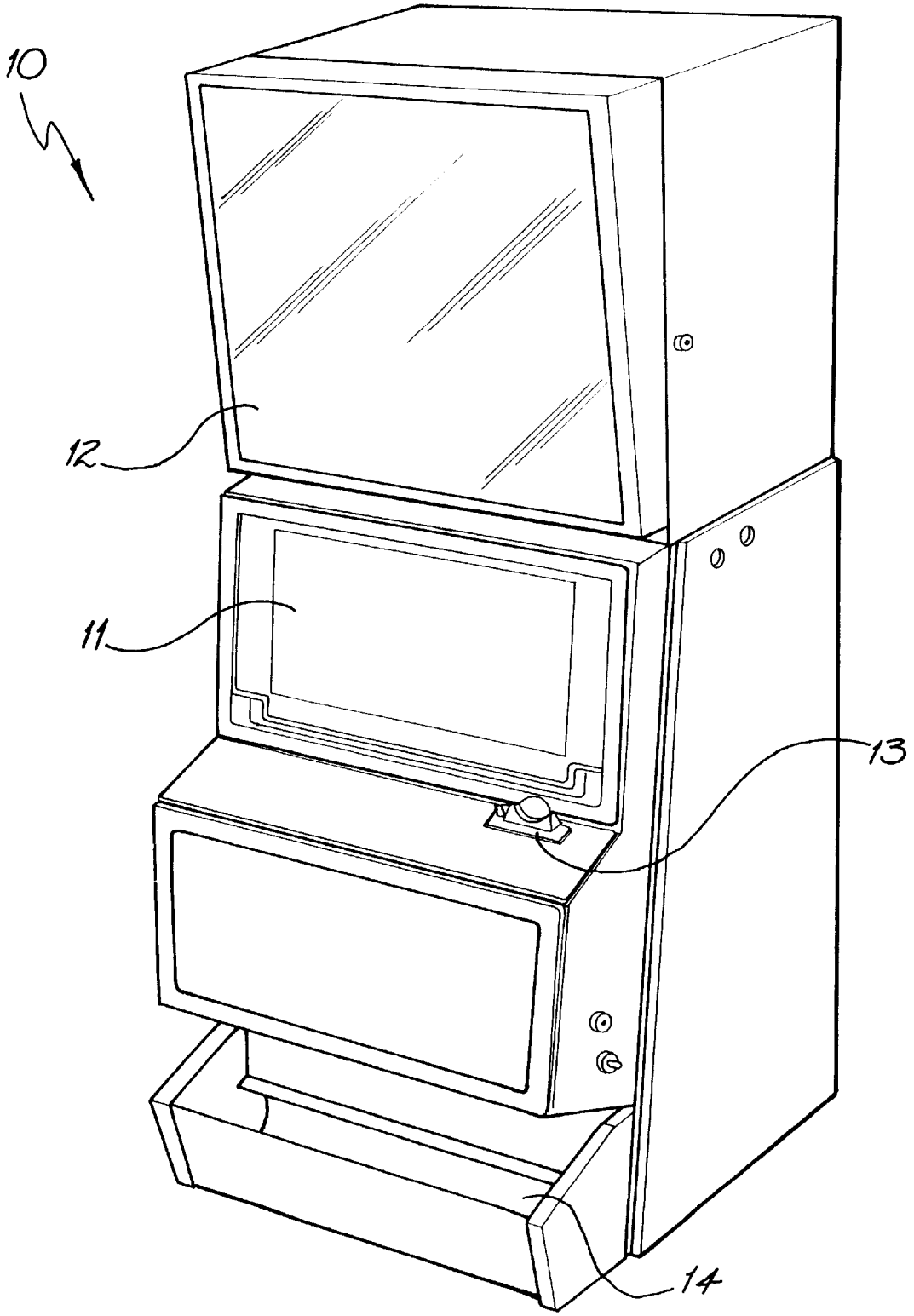
FIG. 1 illustrates a touch screen slot machine incorporating the present invention.
Figure 6:
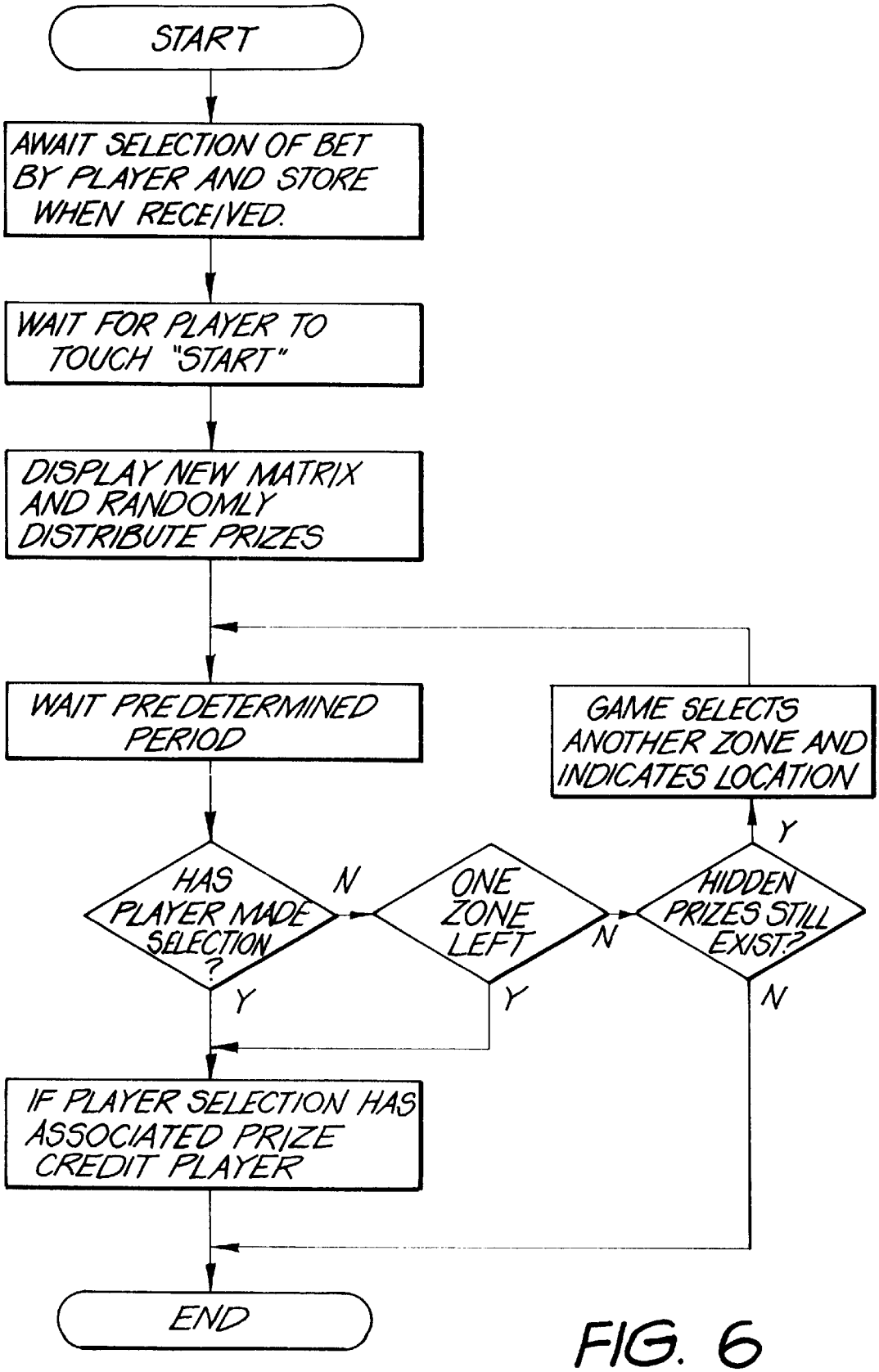
FIG. 6 is a flow chart showing operation of the game described with reference to FIG. 2.

Referring to FIG. 1, the illustrated embodiment of the invention is housed in a conventional slot machine cabinet 10 including a prize display 12, a coin entry slot 13, a payout tray 14 and internally mounted game control processor circuits (refer to FIG. 6).

Preferably, the game display means 11 comprises a video display screen 11 controlled to display a game image divided into a matrix of elements or player selectable zones. The video screen is preferably of the touch sensitive variety, having an array of touch sensitive areas located on its display surface with one such area associated with each matrix element 40-54 (refer to FIG. 2). The player may select one of the matrix elements (eg. 41) by touching the screen within the area of the respective element to be selected, thereby causing the image in the element to change to reveal whether or not a prize value is associated with that zone. Additional player controls may be implemented by displaying images 18, 19, 20, 21, 22, 23, corresponding to controls on the screen such that when the control images are touched, the associated function is caused to be performed.

Figure 2:
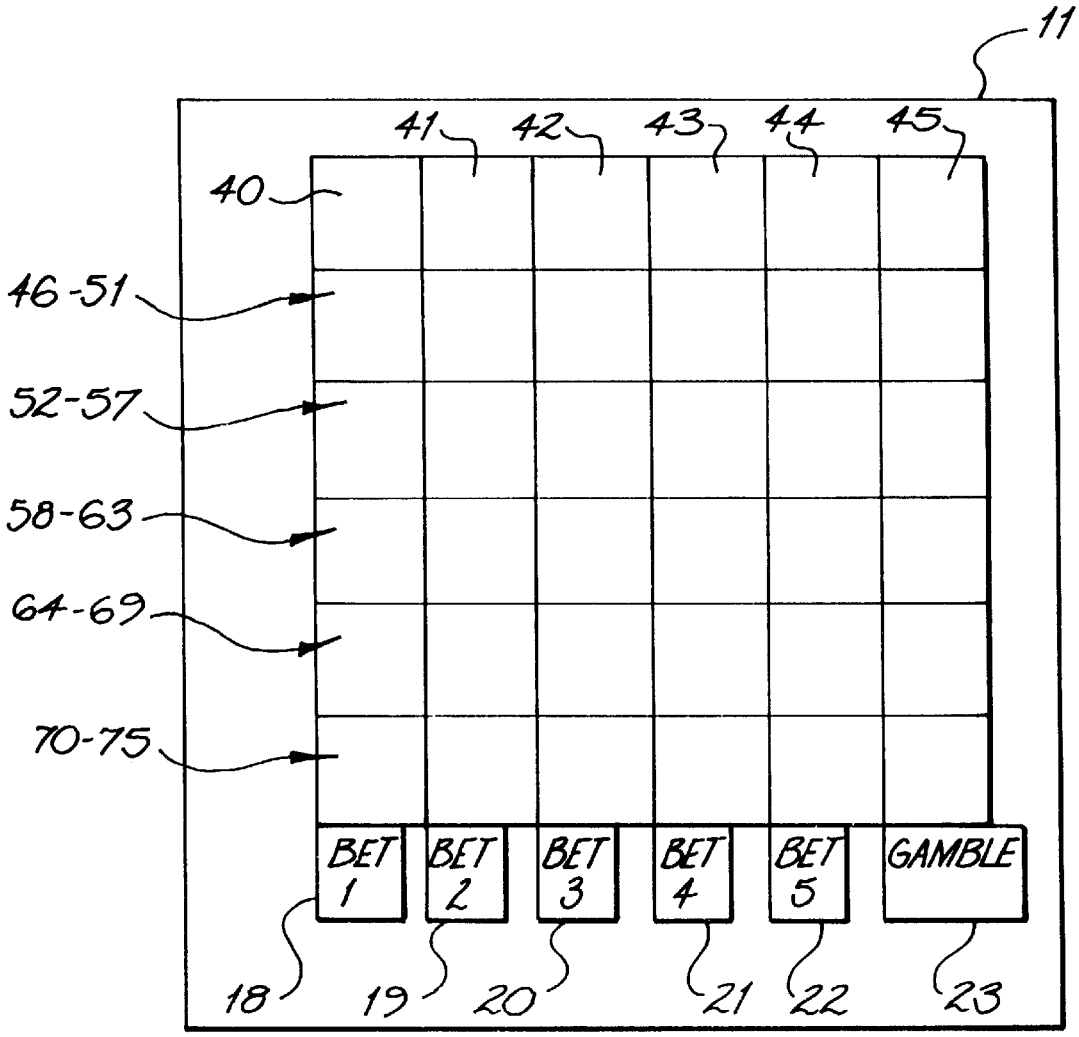
FIG. 2 illustrates a screen layout for an embodiment of the invention.

Referring to FIG. 2, a screen layout is illustrated for a first embodiment of the invention. In this embodiment, one such player control is a gamble button 23, which when touched causes a game to be initiated. Additionally, buttons 18, 19, 20, 21 and 22 enable bets of 1–5 credits to be placed on each game.

First the player selects his bet which will be deducted from his available credit when the game is commenced (and will cause the prize to be multiplied by the number of bet units selected). In some embodiments bet selection may not be provided and all bets will be of one unit or, alternatively, the game would be played as a feature or bonus game where the player is provided the opportunity to improve the prize won in the preceding main game.

After the player has selected his bet using buttons 18–22, if applicable, he starts the game by pressing the start button 23, and may then immediately select an image element by touching the appropriate screen position (eg. 49).

In the event that the player does not select a zone within a predetermined time (eg 3 seconds) the game will commence revealing zones randomly until all zones with associated prize values have been revealed. The game will reveal zones at a predetermined rate, of for example, one zone every 2 seconds. When each zone is selected, either by the player or the game, the selected zone will change state to indicate that it has been selected and remain in its new state until the end of the game. Also, if any selected zone has a prize associated with it, it will indicate the value of that prize. In the event that the game continues until there is only one unselected zone and the player still has not made a selection, the last zone will be automatically taken to the player selection; and by definition this zone must have a prize associated with it, otherwise the game would have already ended.

In the event that the zone selected by the player, or allocated to him has a prize associated with it, that prize (or its value) will be credited to the player.

Figure 3:
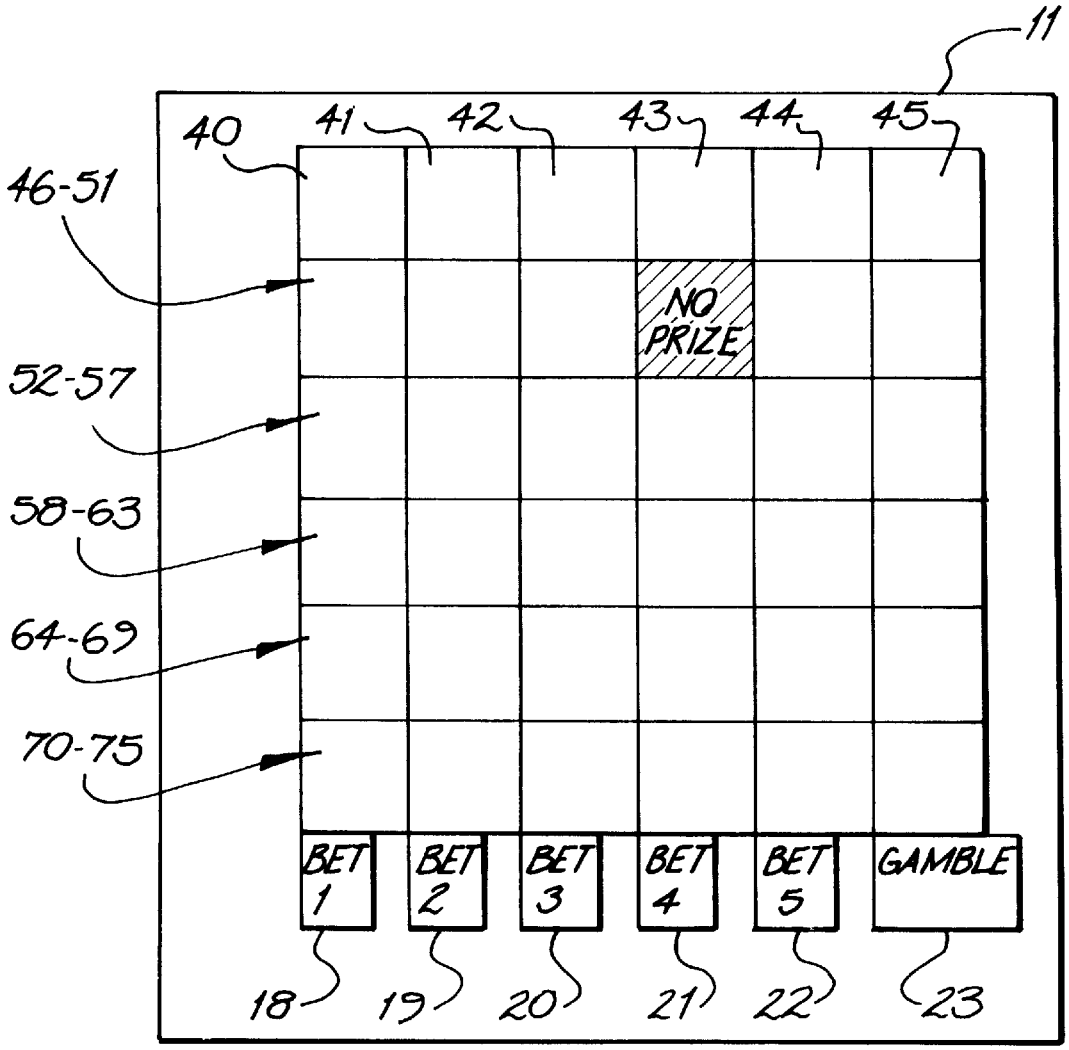
FIG. 3 illustrates the screen layout of FIG. 2 after a winning zone has been selected.

Referring to FIG. 3, the game of FIG. 2 is shown, when the player has selected a zone prior to the game making any selections. In this case zone 49 was selected and has revealed the message "no prize".

Figure 4:
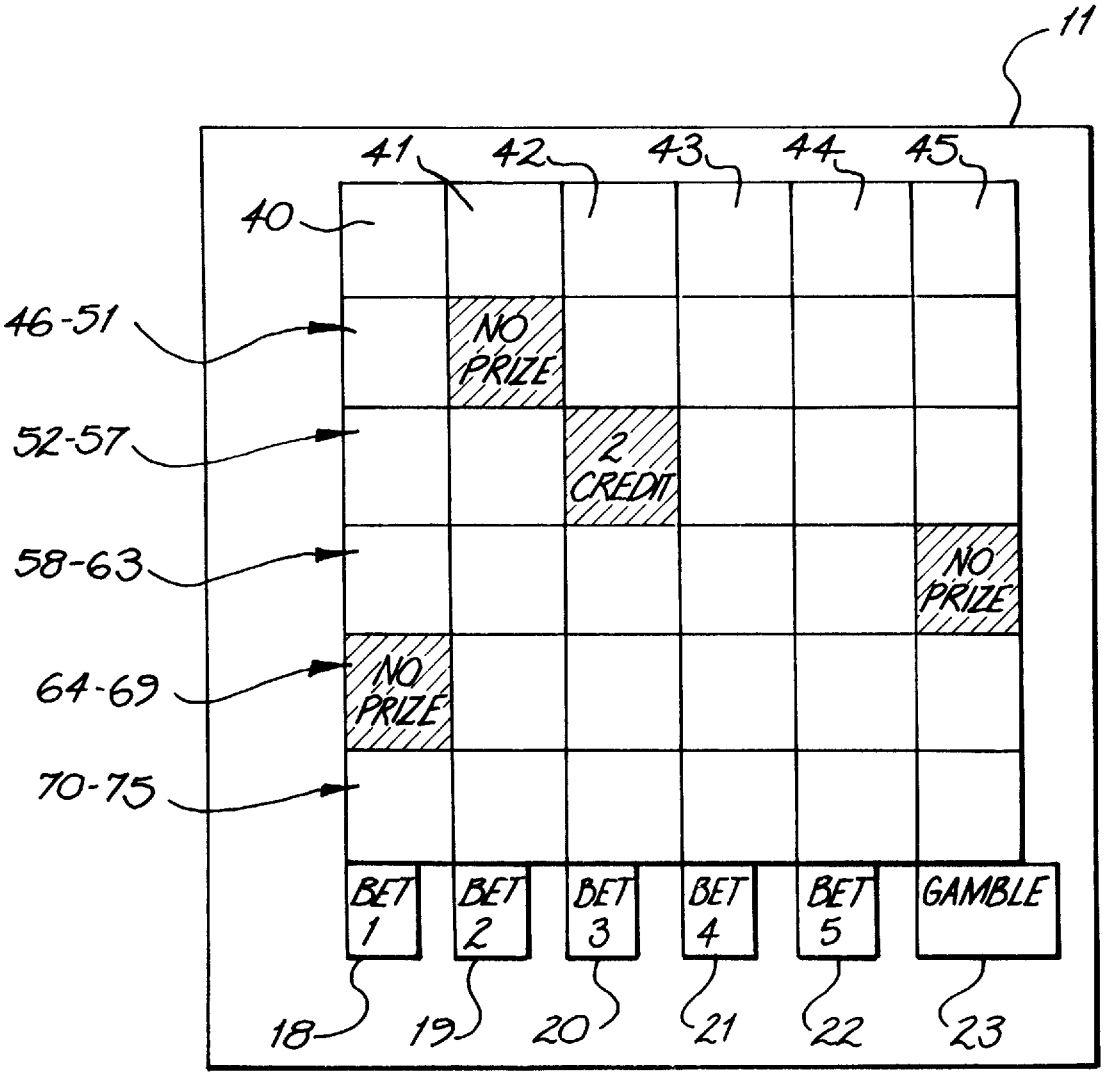
FIGS. 4 and 5 illustrate the screen layout of FIG. 2 after several zones have been selected by the machine.
Figure 5:
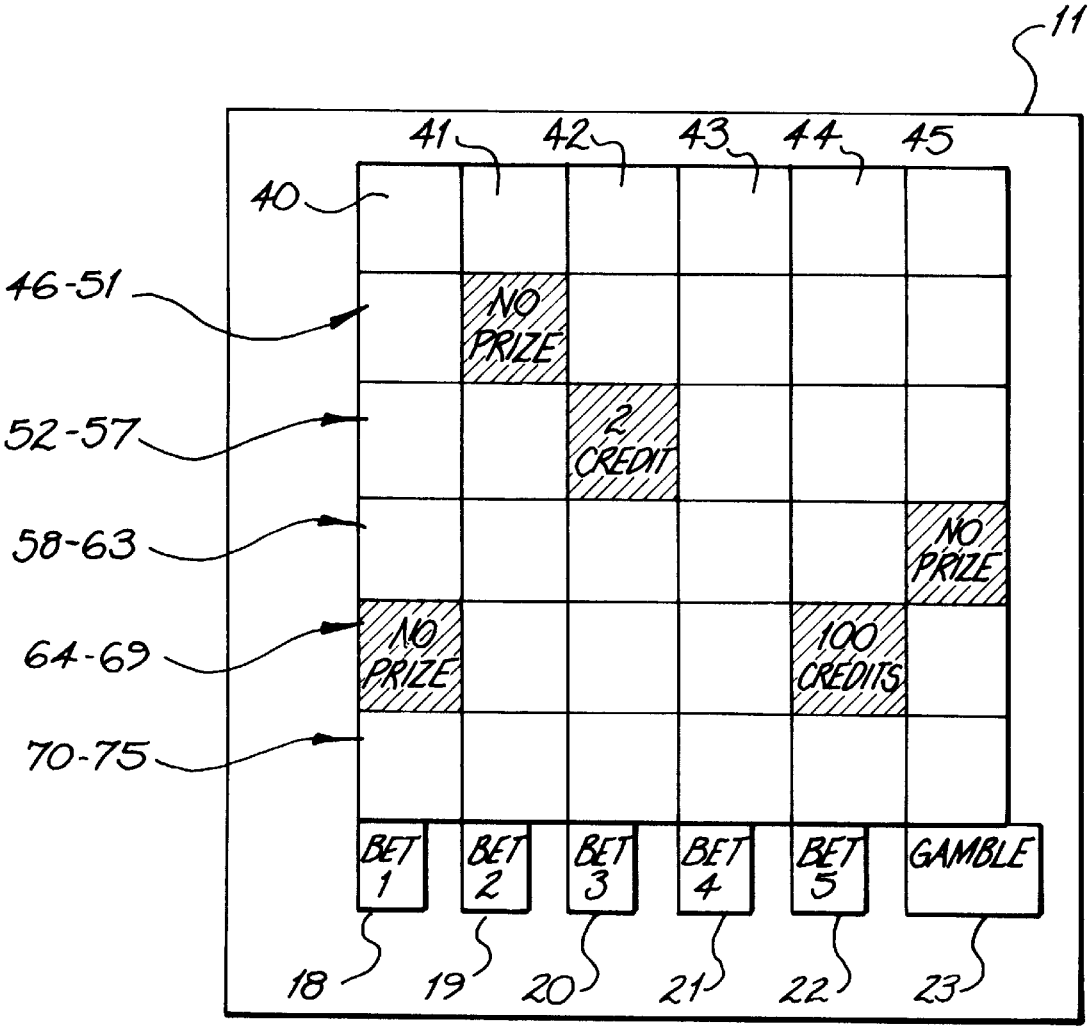

Referring to FIGS. 4 and 5, while the player does not make a selection the game selects zones periodically and, any associated prize indicia will be displayed (2 credits in the case of zone 54) to reveal a prize value. In the event that the player selects a zone associated with a prize, the prize is awarded to the player. The prize will be the value revealed (100 credits in the case of zone 68) multiplied by the number of credits bet, if appropriate.

Game selections and player selections are preferably indicated differently, for example by changing to different colours.

Referring to FIG. 6, a flow diagram is illustrated to show the logic of a control program which controls the operation of the game. From this diagram it will be noted that, after starting, the machine awaits selection of a bet by the player and the touching of the start button 23 to commence the game. The control program then causes the display of an image comprising a matrix of image elements or zones and randomly associates prizes with a predetermined number of displayed indicia. The game image may be the same for each game or may be a variation on the same theme with different backgrounds and orientations of characters etc. The game then waits a predetermined period and if the player has not made a selection the game tests that the number of unselected zones is greater than one and and the number of hidden prizes is greater than zero and, if so, the game selects another zone. When the player makes a selection or if there is only one zone left unselected, the game checks to see if the player has won a prize and if so credits the player with the prize and the game ends. In the event that the player has not made a selection and there are no prizes remaining hidden the game also ends.

It will be appreciated that while the flow diagram of FIG. 6 shows a linear program sequence the testing for player selection may be occurring continuously by way of a hardware interrupt subroutine triggered either by a timer or an input detection circuit, in which case the input testing step may occur at any point in the loop. This alternative arrangement is illustrated in the flow diagram of FIG. 7.

Figure 7:
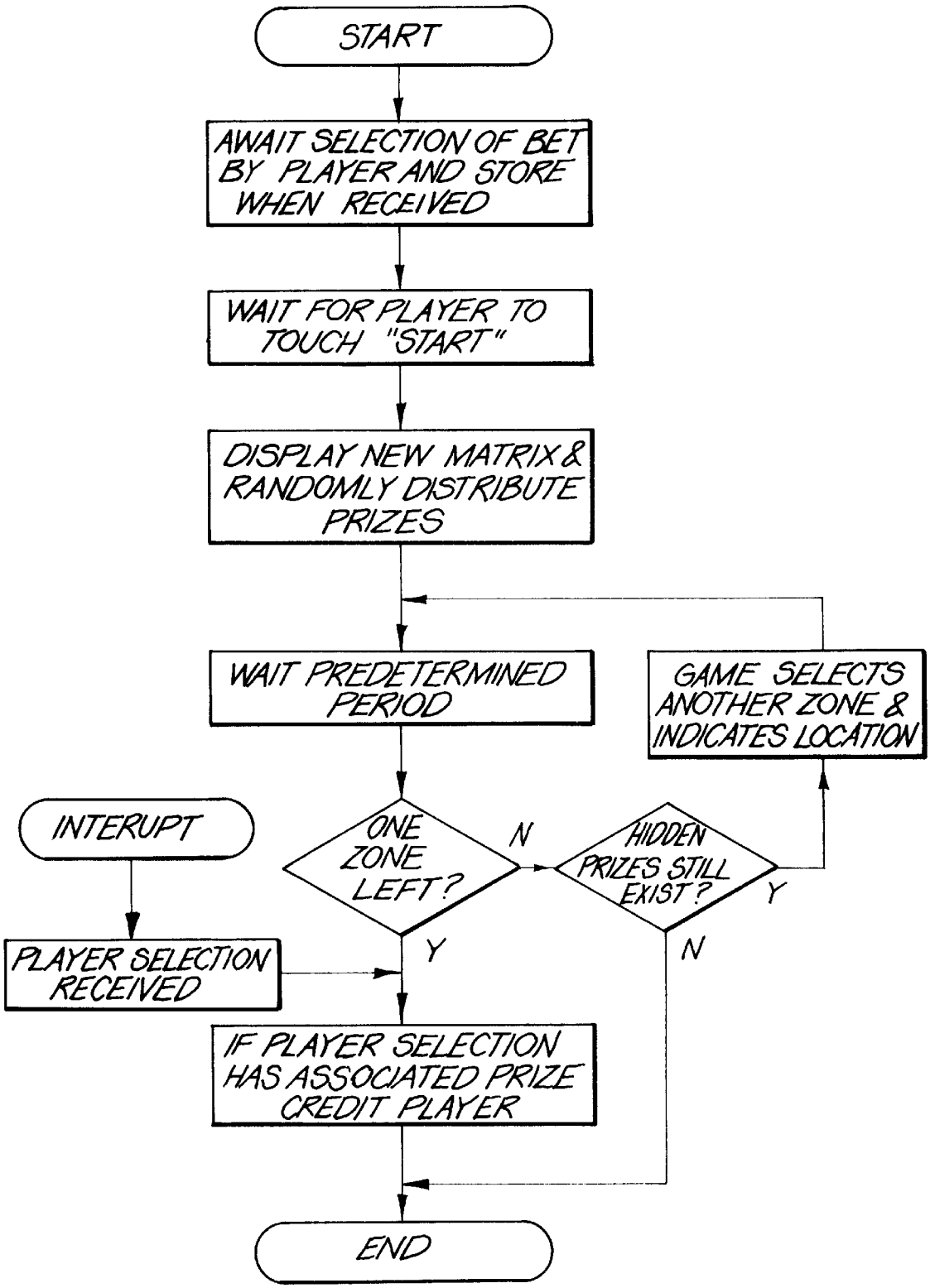
FIG. 7 is a flow chart showing an alternative operation of the game to that illustrated in FIG. 6.
Figure 8:
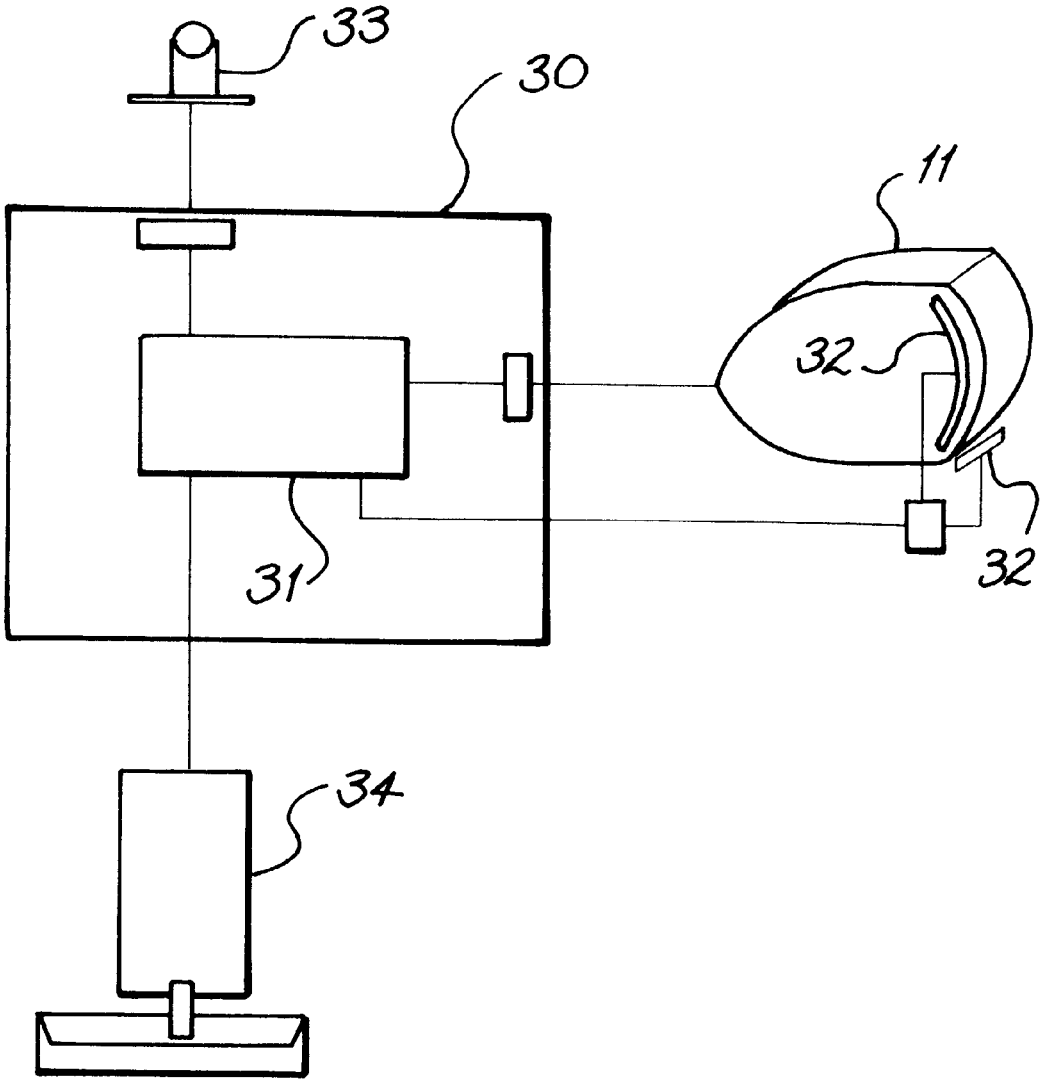
FIG. 8 is a schematic diagram of a slot machine control circuit.

The program to implement the sequence of FIGS. 6 or 7 runs on a standard gaming machine control processor 31 as illustrated schematically in FIG. 8. This processor forms part of a controller 30 which drives the display screen 11 and receives touch input signals from touch sensors 32 as well as receiving coin input pulses from a coin chute mechanism 33 and driving a coin payout mechanism 34.

It will also be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A gaming machine comprising:

display means arranged to display a game being played on the machine;

game initiating means to initiate a game on the machine; and game control means responsive to the initiating means to control the playing of the game, wherein:

the display means is arranged to display at least one game image having a plurality of player selectable zones;

the control means includes player zone selection means;

a prize randomly associated with at least one of the zones such that if that zone is selected by a players the player will be awarded the associated prize, wherein the control means is arranged:

to randomly select zones of the plurality of zones, thereby removing the selected zone from the group selectable by the player; and to indicate for each selected zone whether that zone has an associated prize, wherein in the event that all of the zones having associated prizes are selected by the control means the game stops with no associated prize being awarded, or the game stops if the player selects a prize zone with no asociated prize.

2. The gaming machine of claim 1, wherein the display means displays a background image of the game image for the game which is a static image.

3. The gaming machine of claim 2, wherein the background image is a fixed pattern.

4. The gaming machine of claim 1, wherein the display means displays a background image of the game image for the game which is a dynamic image.

5. The gaming machine of claim 4, wherein the background image is an animation.

6. The gaming machine of claim 1, wherein the display means displays a matrix of zone images which form the game image.

7. The gaming machine of claim 6, wherein each zone image has a static image.

8. The gaming machine of claim 6, wherein each zone image is a fixed pattern.

9. The gaming machine of claim 6, wherein each zone image is a dynamic image.

10. The gaming machine of claim 9, wherein each zone image is an animation.

11. The gaming machine as claimed in any one of claims 2 or 4, wherein the game image is an image of a golfer teeing off, such that the game image gives a clue to the player as to the zone having a prize associated with it.

12. The gaming machine as claimed in any one of claims 2 or 4, wherein the game image is an image of a football player kicking a ball, such that the game image gives a clue to the player as to the zone having a prize associated with it.

13. The gaming machine as claimed in any one of claims 2 or 4, wherein the game image is an image of a rugby player passing a ball, such that the game image gives a clue to the player as to the zone having a prize associated with it.

14. The gaming machine as claimed in any one of claims 2 or 4, wherein the game image is an image of an angler casting a fly, such that the game image gives a clue to the player as to the zone having a prize associated with it.

15. The gaming machine as claimed in any one of claims 2 or 4, wherein the game image is an image of a battleship dropping depth charges, such that the game image gives a clue to the player as to the zone having a prize associated with it.

16. The gaming machine as claimed in any one of claims 2 or 4, wherein the game image is an image of a battleship firing missiles, such that the game image gives a clue to the player as to the zone having a prize associated with it.

17. The gaming machine as claimed in any one of claims 1 to 10, wherein clues to zones having associated prizes are permanently or temporarily revealed in zones that have been randomly selected by the control means.

18. The gaming machine as claimed in any one claims 1 to 10, wherein clues to zones having associated prizes are permanently or temporarily displayed in unselected zones.

19. A gaming machine, comprising;

display means arranged to display a game being played on the machine;

game initiating means to initiate a game on the machine;

game control means responsive to the initiating means to control the playing of the game, wherein:

the display means is arranged to display a game image having a plurality of player selectable zones;

the control means including player zone selection means including touch sensors associated with the display means and located such that touching the display means within one of the player selectable zones causes the respective zone to be selected;

a prize being randomly associated with at least one of the zones such that if that zone is selected by a player the player will be awarded the associated prize; and wherein the control means is arranged:

to randomly select zones of the plurality of zones thereby removing the selected zone from the group selectable by the player; and to indicate for each selected zone whether that zone has an associated prize, the random selection being continued by the control means until either, the player selects a zone with no associated prize, or all of the zones with associated prizes have been selected by the control means.

20. The gaming machine of claim 19, wherein the display means displays a background image for the game which is a static image.

21. The gaming machine of claim 20, wherein the image is a fixed pattern.

22. The gaming machine of claim 19, wherein the display means displays a background image for the game which is a dynamic image.

23. The gaming machine of claim 22, wherein the image is an animation.

24. The gaming machine of claim 19, wherein the display means displays a matrix of zone images.

25. The gaming machine of claim 24, wherein each zone image has a static image.

26. The gaming machine of claim 24, wherein each zone image is a fixed pattern.

27. The gaming machine of claim 24, wherein each zone image is a dynamic image.

28. The gaming machine of claim 27, wherein each zone image is an animation.

29. The gaming machine of claim 28, wherein the display image or images provide clues as to the probability of each zone having an associated prize.

30. A gaming machine, comprising;

display means arranged to display a game being played on the machine;

game initiating means to initiate a game on the machine;

game control means responsive to the initiating means to control the playing of the game, wherein:

the display means is a video screen on an LCD panel and is arranged to display a game image having a plurality of player selectable zones;

the control means includes player zone selection means including touch sensors associated with the display means and located such that touching the display means within one of the player selectable zones causes the respective zone to be selected;

a prize being randomly associated with at least one of the zones such that if that zone is selected by a player the player will be awarded the associated prize; and wherein the control means is arranged:

to randomly select zones of the plurality of zones thereby removing the selected zone from the group selectable by the player; and to indicate for each selected zone whether that zone has an associated prize, the random selection being continued by the control means until either, the player selects a zone with no associated prize, or all of the zones with associated prizes have been selected by the control means.

31. The gaming machine of claim 30, wherein the display means displays a background image for the game which is a static image.

32. The gaming machine of claim 30, wherein the image is a fixed pattern.

33. The gaming machine of claim 30, wherein the display means displays a background image for the game which is a dynamic image.

34. The gaming machine of claim 33, wherein the image is an animation.

35. The gaming machine of claim 30, wherein the display means displays a matrix of zone images.

36. The gaming machine of claim 35, wherein each zone image has a static image.

37. The gaming machine of claim 36, wherein each zone image is a fixed pattern.

38. The gaming machine of claim 36, wherein each zone image is a dynamic image.

39. The gaming machine of claim 38, wherein each zone image is an animation.

40. The gaming machine of claim 30, wherein the display image or images provide clues as to the probability of each zone having an associated prize.

41. The gaming machine of claim 31 or 33, wherein the display image is an image of a golfer teeing off, such that the screen image gives a clue to the player as to the zone having a prize associated with it.

42. The gaming machine of claim 31 or 33, wherein the display image is an image of a football player kicking a ball, such that the screen image gives a clue to the player as to the zone having a prize associated with it.

43. The gaming machine of claim 31 or 33, wherein the display image is an image of a rugby player passing a ball, such that the screen image gives a clue to the player as to the zone having a prize associated with it.

44. The gaming machine of claim 31 or 33, wherein the display image is an image of an angler casting a fly, such that the screen image gives a clue to the player as to the zone having a prize associated with it.

45. The gaming machine of claim 31 or 33, wherein the display image is an image of a battleship dropping depth charges, such that the screen image gives a clue to the player as to the zone having a prize associated with it.

46. The gaming machine of claim 31 or 33, wherein the display image is an image of a battleship firing missiles, such that the screen image gives a clue to the player as to the zone having a prize associated with it.

47. The gaming machine of claim 30, wherein clues to zones having associated prizes are revealed in zones that have been randomly selected by the control means.

48. The gaming machine of claim 30, wherein clues to zones having associated prizes are displayed in unselected zones.

49. A gaming machine, comprising:

display means arranged to display a game being played on the machine;

game initiating means to initiate a game on the machine;

game control means responsive to the initiating means to control the playing of the game, wherein:

the display means is arranged to display a game image or game images having a plurality of player selectable zones;

the control means includes player zone selection means;

a prize being randomly associated with at least one of the zones such that if that zone is selected by a player the player will be awarded the associated prize; and wherein the control means is arranged:

to randomly select zones of the plurality of zones, thereby removing the selected zone from the group selectable by the player; and to indicate for each selected zone whether that zone has an associated prize, the random selection being continued by the control means until either, the player selects a zone with no associated prize, or all of the zones with associated prizes have been selected by the control means and clues to zones having associated prizes, are revealed in zones that have been selected by the control means.

50. A gaming machine, comprising display means arranged to display a game being played on the machine;

game initiating means to initiate a game on the machine and game control means responsive to the initiating means to control the playing of the game, wherein:

the display means is arranged to display a game image or game images having a plurality of player selectable zones;

the control means including player zone selection means;

a prize being randomly associated with at least one of the zones such that if that zone is selected by a player the player will be awarded the associated prize; and the control means is arranged to:

randomly select zones of the plurality of zones, thereby removing the selected zone from the group selectable by the player; and to indicate for each selected zone whether that zone has an associated prize, the random selection being continued by the control means until either, the player selects a zone with no associated prize, or all of the zones with associated prizes have been selected by the control means and clues to zones having associated prizes, are displayed in unselected zones.

51. The gaming machine of claim 1, wherein the control means selects zones one at a time.

* * * * *